US006112427A

United States Patent [19]

Plociennik et al.

[11] Patent Number: 6,112,427

[45] Date of Patent: Sep. 5, 2000

[54] COOLING SHAFT FOR A ROLLER CONVEYOR

[75] Inventors: Uwe Plociennik, Ratingen; Dieter Waase, Kaarst, both of Germany

[73] Assignee: SMS Schloemann-Siemag Aktiengesellschaft, Düsseldorf, Germany

[21] Appl. No.: 09/263,997

[22] Filed: Mar. 6, 1999

[30] Foreign Application Priority Data

Mar. 10, 1998 [DE] Germany ..... 198 10 215

[51] Int. Cl.[7] ..... F26B 19/00

[52] U.S. Cl. ..... 34/66; 34/236; 34/240; 148/595; 266/106; 72/201

[58] Field of Search ..... 34/429, 430, 61, 34/62, 65, 66, 103, 110, 114, 124, 192, 193, 236, 240; 148/595, 598, 600; 72/200, 201, 202, 234; 62/64

[56] References Cited

U.S. PATENT DOCUMENTS

| | | | |
|---|---|---|---|
| 4,401,481 | 8/1983 | Gilvar et al. | 148/595 |
| 4,448,401 | 5/1984 | Jalil et al. | 266/78 |
| 4,491,488 | 1/1985 | Gilvar et al. | 266/106 X |
| 4,580,353 | 4/1986 | Jalil et al. | 34/429 |
| 5,121,902 | 6/1992 | Jalil et al. | 266/106 |
| 5,299,783 | 4/1994 | Ledger et al. | 266/106 |
| 5,619,808 | 4/1997 | Pabst | 34/640 |
| 5,907,967 | 6/1999 | Kleinfeldt et al. | 72/201 |

FOREIGN PATENT DOCUMENTS 0110652 6/1984 European Pat. Off. .

*Primary Examiner*—Stephen Gravini
*Attorney, Agent, or Firm*—Friedrich Kueffner

[57] ABSTRACT

A cooling shaft for the rollers of a roller conveyor includes a flow duct for the cooling medium and an outlet opening. The cooling shaft includes the flow duct for the cooling medium and at least one length portion extending upwardly from the flow duct, wherein the length portion has an outlet opening and ends below the axes of the rollers. The cross-section of the flow duct in the transition from the flow duct and the length portion is smaller than the outlet opening and at least one side of the length portion is curved outwardly.

12 Claims, 1 Drawing Sheet

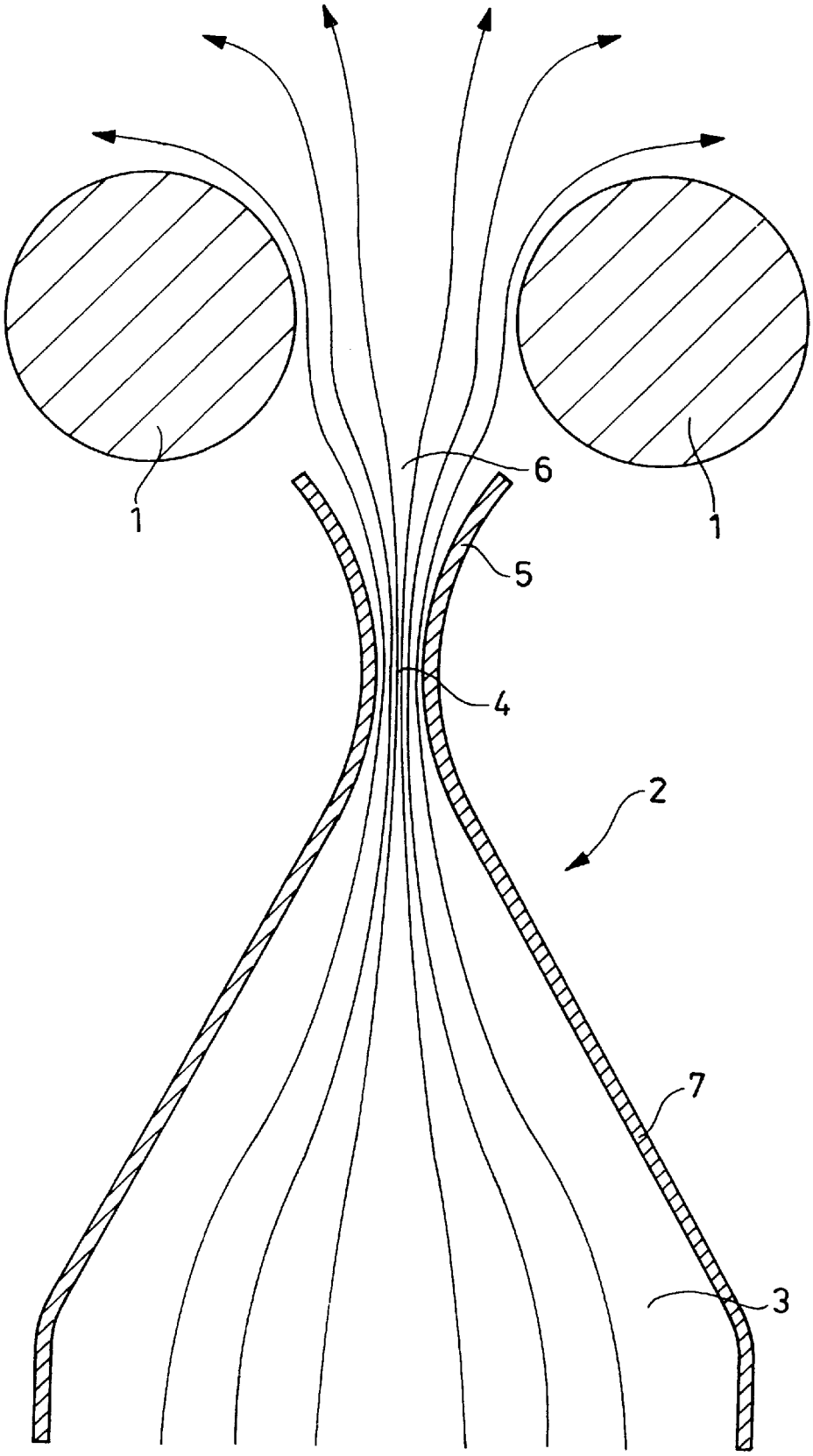
1
1
6
5
4
2
7
3

COOLING SHAFT FOR A ROLLER CONVEYOR

BACKGROUND OF THE INVENTION

1. Field of the Invention

The present invention relates to a cooling shaft for the rollers of a roller conveyor. The cooling shaft includes a flow duct for the cooling medium and an outlet opening.

2. Description of the Related Art

The cooling shaft is to be used particularly for carrying out the STELMOR® process. In the conventional STELMOR® process, long drawn products, particularly wire, are coiled into coils and are conveyed in the form of rings over a roller conveyor. As the wire is conveyed it is cooled while simultaneously its mechanical properties are influenced. The cooling medium usually is air which is blown through the conveyor and through the wire rings.

However, it is also desirable that cooling of the rings does not occur too rapidly. For example, for influencing the temperature conditions, devices are known, so called hot boxes, in which the wire rings are conveyed through a zone in which the warm air is applied from the bottom and from above and temperature differences can be compensated in this manner.

European Patent Application 0 110 652 describes a Stelmor line with appropriate cooling devices. It is generally suggested to arrange the air flow ducts near the rollers of the roller conveyor in such a way that the air flow flows along a roller and then toward the wire material. Specifically, the air flow shafts are to be located underneath the respective rollers, so that the air flow separates when it impinges against the bottom side of the roller and then flows along the roller and toward the bottom side of the wire windings.

It is further proposed in this European Patent Application to direct the air flow by having air flow through perforated conveyor rollers.

SUMMARY OF THE INVENTION

Therefore, it is the primary object of the present invention to influence the cooling properties in a cooling shaft in a roller conveyor.

In accordance with the present invention, the cooling shaft includes the flow duct for the cooling medium and at least one length portion extending upwardly from the flow duct, wherein the length portion has an outlet opening and ends below the axes of the rollers. The cross-section of the flow duct in the transition from the flow duct and the length portion is smaller than the outlet opening and at least one side of the length portion is curved outwardly.

Accordingly, the gist of the present invention is the proposed shape of a cooling shaft. The cooling shaft, which is to be used particularly in a STELMOR® line, is composed of a flow duct for the cooling medium, preferably air, and least one length portion extending upwardly from the flow duct.

In accordance with the invention, the cross-section at the transition between the flow duct and the length portion is smaller than the outlet opening and at least one side of the length portion is curved outwardly.

The cooling effect by means of air generally depends on the factors air velocity and cooling time. If, as proposed, the air flow first flows as a result of the shape of the cooling duct through a relatively narrow portion and then along a curved surface, the result which is achieved is the fact that the flow exits tangentially. If the Reynolds numbers are sufficiently high, the air jet is broken open. The velocity of the jet decreases while the dwell time of the wire coils in the air flow is increased. However, although the air velocity is lower, the total cooling of the wire is still intensified or increased because the cooling effect can occur over a surface of the cooling area which is greater because of the longer dwell time.

The reason for the behavior of the air flow described above can be found in the so called Coanda effect. This effect describes the behavior of liquid and gas jets to adhere to fixed walls which are located in the vicinity of the jet and to then flow along the fixed wall. The jet emerges tangentially from a narrow slot arranged immediately adjacent a circular surface and flows along this circular surface. When the Reynolds number is sufficiently high, the jet becomes turbulent and entrains medium which is at rest. This causes the width of the jet to increase with increasing distance from the slot and the velocity of the jet decreases.

The advantageous effect of the invention, i.e., the influence on the flow of air by utilizing the Coanda effect already occurs when only one side of the length portion of the cooling shaft is curved above the transition. This side advantageously has approximately a circular curvature.

Various shapes of the cooling shaft are conceivable. The flow duct may have a rectangular cross-section with four wall portions wherein at least two oppositely located wall portions are curved outwardly. The edges of the outwardly curved wall portions extend transversely of the conveying direction of the roller conveyor.

In accordance with another feature, the flow duct has a circular cross-section and only one length portion which opens in the shape of a funnel.

In accordance with another embodiment of the invention, the cooling shaft may be shaped in such a way that the walls of the flow duct underneath the transition are also curved outwardly and the cooling shaft has the smallest cross-section at the transition. Consequently, in the longitudinal section, the cooling shaft has a concave shape.

In order to be even better able to influence the cooling conditions, it is proposed in accordance with another feature to connect a plurality of cooling shafts arranged next to each other in the rolling direction by means of insulating elements and to displace these connected elements underneath the roller conveyor. This makes it possible to move the cooling shafts from the centric position between these two rollers underneath the rollers. The advantage of this is that the cooling is additionally delayed because the hot conveyed material, particularly the wire rings, radiates heat toward the insulation between the shafts or the outlet openings and, thus, is prevented from being cooled.

In accordance with an alternative embodiment, it is also possible to mount the cooling shafts and insulating elements in a fixed position and to displace the roller conveyor.

As already mentioned, the cooling medium may be air. However, it is also possible to use a water/air mixture for auxiliary cooling.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

The single FIGURE of the drawing is a cross-sectional view of a portion of a STELMOR® line.

DESCRIPTION OF THE PREFERRED EMBODIMENTS

The drawing shows two rollers 1 of a roller conveyor of a Stelmor line and an air cooling shaft 2 arranged centrically between the two rollers 1. The cooling shaft 2 is composed of a flow duct 3 with a transition 4 to a length portion 5 formed by side walls which extend upwardly up to the outlet opening 6.

In accordance with the present invention, the cross-section of the flow duct at the transition 4 between the flow duct 3 and the length portion 5 is smaller than that of the outlet opening 6.

In an embodiment of the present invention in which the flow duct 3 has a rectangular shape, the length portion 5 above the transition 4 has four side walls. Of these four side walls, only the two side walls arranged transversely of the rolling direction are outwardly curved in a circular shape. In the embodiment illustrated in the drawing, the walls 7 of the cooling shaft are outwardly curved above the transition 4 as well as underneath the transition 4. However, the Coanda effect is basically independent of the shape of the flow duct underneath the transition 4.

During the cooling process, air flows through the narrow transition 4 and emerges immediately tangentially at the curved side walls of the length portion 5. The air which emerges in the vicinity of the rollers 1 is deflected by the rollers 1 until the air flow separates at a certain angle. When the flow becomes turbulent, the jet entrains medium which is at rest. The width of the jet increases, while the air velocity decreases. As the air velocity decreases, the dwell time of the wire, not shown, in the air flow increases.

The proposed cooling shaft is to be used particularly as a component of a cooling line for wire windings, i.e., in a STELMOR® line. It is also conceivable that the cooling shaft is used in any other roller cooling systems, for example, in the secondary cooling zone of a strand cooling system.

While specific embodiments of the invention have been shown and described in detail to illustrate the inventive principles, it will be understood that the invention may be embodied otherwise without departing from such principles.

We claim:

1. A cooling shaft for rollers of a roller conveyor, the cooling shaft comprising a flow duct for cooling medium, a length portion extending upwardly from the flow duct, the length portion having an outlet opening which ends below axes of the rollers, further comprising a transition between the flow duct and the length portion, the transition and the outlet opening each having a cross-section, wherein the cross-section of the transition is smaller than the cross-section of the outlet opening, the length portion having at least one side wall, wherein the at least one side wall is outwardly curved.

2. The cooling shaft according to claim 1, wherein the at least one side wall is curved approximately in a circular shape.

3. The cooling shaft according to claim 1, wherein the flow duct has a rectangular cross-section, wherein the length portion has four side walls, wherein at least two oppositely located side walls are curved outwardly.

4. The cooling shaft according to claim 1, wherein the flow duct has a circular cross-section and the length portion is funnel-shaped.

5. The cooling shaft according to claim 1, wherein the flow duct is formed by walls curved outwardly underneath the transition, and wherein the cooling shaft has a smallest cross-section at the transition.

6. The cooling shaft according to claim 1, wherein the cooling medium is air or a water/air mixture.

7. A cooling system for rollers of a roller conveyor, the cooling system comprising a plurality of cooling shafts arranged next to one another in a rolling direction, each cooling shaft having a flow duct for cooling medium, a length portion extending upwardly from the flow duct, the length portion having an outlet opening which ends below axes of the rollers, each cooling shaft further comprising a transition between the flow duct and the length portion, the transition and the outlet opening each having a cross-section, wherein the cross-section of the transition is smaller than the cross-section of the outlet opening, the length portion having at least one side wall, wherein the at least one side portion is outwardly curved, further comprising insulating elements connecting the cooling shafts.

8. The cooling system according to claim 7, wherein the cooling shafts and insulating elements are connected to one another so as to be displaceable underneath the rollers.

9. The cooling system according to claim 7, wherein the rolling conveyor is configured to be displaceable above the connected cooling shafts and insulating elements.

10. The cooling system according to claim 7, mounted in a cooling line for wire windings.

11. The cooling system according to claim 7, mounted in a line.

12. The cooling system according to claim 7, mounted in a secondary cooling zone of a strand cooling unit.

* * * * *